United States Patent [19]

Hagita et al.

[11] Patent Number: 4,781,528

[45] Date of Patent: Nov. 1, 1988

[54] VARIABLE CAPACITY RADIAL FLOW TURBINE

[75] Inventors: Atsushi Hagita; Nobuyasu Matsudaira; Michio Kyoya; Yoichiro Okazaki, all of Sagamihara, Japan

[73] Assignee: Mitsubishi Jukogyo Kabushiki Kaisha, Tokyo, Japan

[21] Appl. No.: 94,593

[22] Filed: Sep. 9, 1987

[51] Int. Cl.[4] ..... F01D 17/18

[52] U.S. Cl. ..... 415/151

[58] Field of Search ..... 415/148, 150, 151, 159, 415/160, 205

[56] References Cited

U.S. PATENT DOCUMENTS

| | | | |
|---|---|---|---|
| 3,313,518 | 4/1967 | Nancarrow | 415/148 X |
| 4,027,994 | 6/1977 | MacInnes | 415/205 X |
| 4,143,994 | 3/1979 | Yamaguchi | 415/205 |
| 4,519,211 | 5/1985 | Sedille et al. | 415/205 X |

FOREIGN PATENT DOCUMENTS

| | | | |
|---|---|---|---|
| 59-54709 | 3/1984 | Japan | 415/150 |
| 60-6020 | 1/1985 | Japan | 415/205 |

*Primary Examiner*—Robert E. Garrett
*Assistant Examiner*—Joseph M. Pitko
*Attorney, Agent, or Firm*—Wenderoth, Lind and Ponack

[57] ABSTRACT

A variable capacity radial flow turbine includes a turbine housing which incorporates a turbine wheel and which forms a working gas passageway that leads to the turbine wheel and that is divided into two parts. The working gas passageway is provided with a pivotable plate-like member, so that the flow rate of the working gas flowing into the turbine wheel can be continuously changed by shifting the position of this member and thus opening or closing part of a working gas intake.

2 Claims, 4 Drawing Sheets

VARIABLE CAPACITY RADIAL FLOW TURBINE

BACKGROUND OF THE INVENTION

1. Field of the Invention

The present invention relates to an exhaust turbo-charger for use in an internal combustion engine. The present invention also pertains to a radial flow gas turbine which has the same structure as that of an exhaust turbo-charger.

2. Prior Art

FIG. 8 shows the structure of a conventional variable capacity radial flow turbine. A turbine housing 31 of the radial flow turbine has therein a turbine wheel 32, and defines a passageway 35 for a working gas such as exhaust gas. A vane 33 is provided in a working gas intake 36 of the passageway 35 through which the gas flows into the turbine wheel 32. The turbine flow rate is varied by opening and closing the vane 33.

FIG. 9 shows a turbine housing 31 of another variable capacity radial flow turbine which is not equipped with a capacity varying mechanism and which has an exhaust passageway 35 divided into two chambers by a partition 20.

When a variable capacity radial flow turbine of the type shown in FIG. 8 is used with a multicylinder engine, the effect of pulsations in the exhaust is reduced. This reduction in the effect of pulsations has therefore made it difficult to obtain a high charging pressure when the rotational speed of the engine is low.

With a turbine having a turbine housing with a partition such as that shown in FIG. 9, the pulsations in the exhaust can be effectively utilized. However, it does not have any capacity varying mechanism, resulting in a narrowing of the suitable matching range.

SUMMARY OF THE INVENTION

The present invention has been developed for the purpose of obviating the above noted disadvantages of the prior art. Accordingly, the object of the present invention is to provide a variable capacity radial·flow turbine having a turbine housing which forms a working gas passageway which leads to a turbine wheel incorporated in the turbine housing and which is divided into two parts. A pivotable plate-like member is provided in the work gas passageway, so that the flow rate of the working gas flowing into the turbine wheel can be continuously changed by shifting the position of the plate-like member and thus opening and closing part of a working gas intake.

The shifting of the pivotable member provided in the working gas passageway of the turbine housing changes a ratio A/R (obtained by dividing the sectional area A of the flow passage at a scroll-like entrance thereof by the perpendicular distance R from the central axis of a rotor to the centroid of the sectional area at the scroll entrance), so that the acceleration of the working gas flowing through the working gas passageway is changed, and the flow rate characteristics of the turbine are changed thereby.

DESCRIPTION OF THE PREFERRED EMBODIMENTS

Figure 1:
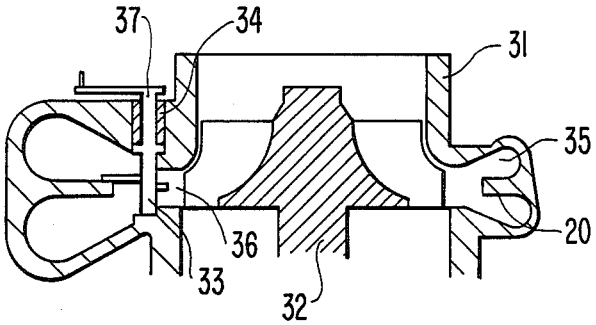
FIG. 1 is a cross-sectional view of a first embodiment of the present invention.
Figure 2:
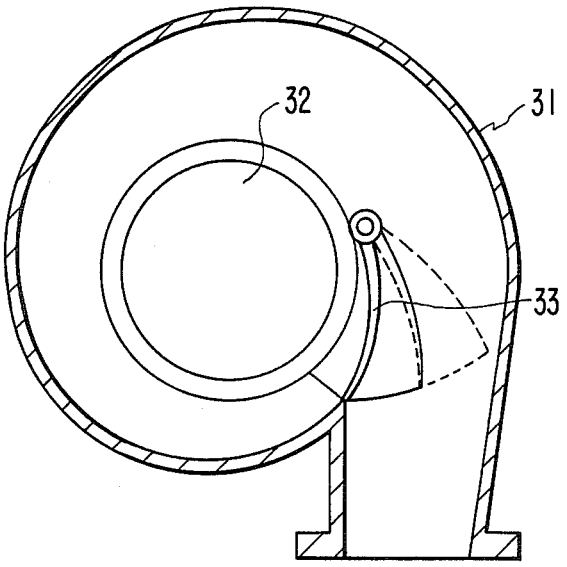
FIG. 2 is a longitudinal sectional view of the turbine housing of FIG. 1, showing the state in which a vane is closed.
Figure 3:
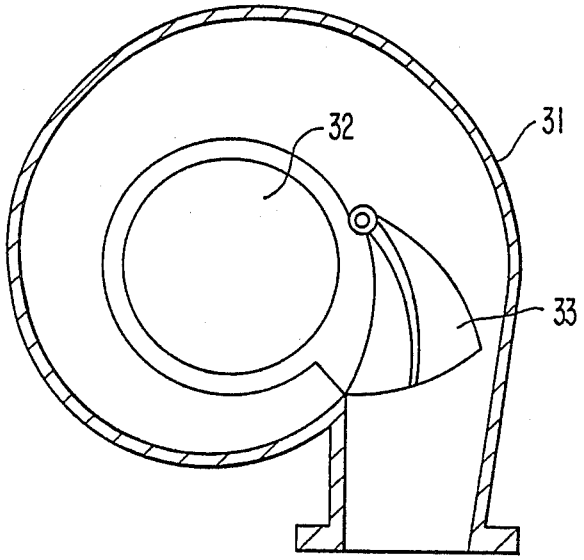
FIG. 3 is a longitudinal sectional view of the turbine housing of FIG. 1, showing the state in which the vane is open.
Figure 4:
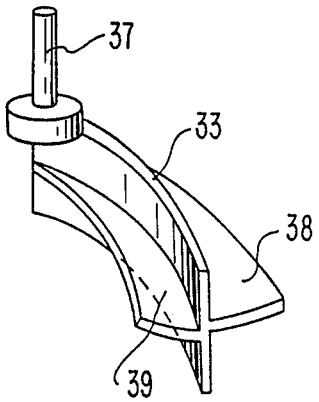
FIG. 4 is a perspective view of the vane employed in the first embodiment of the present invention.
Figure 5:
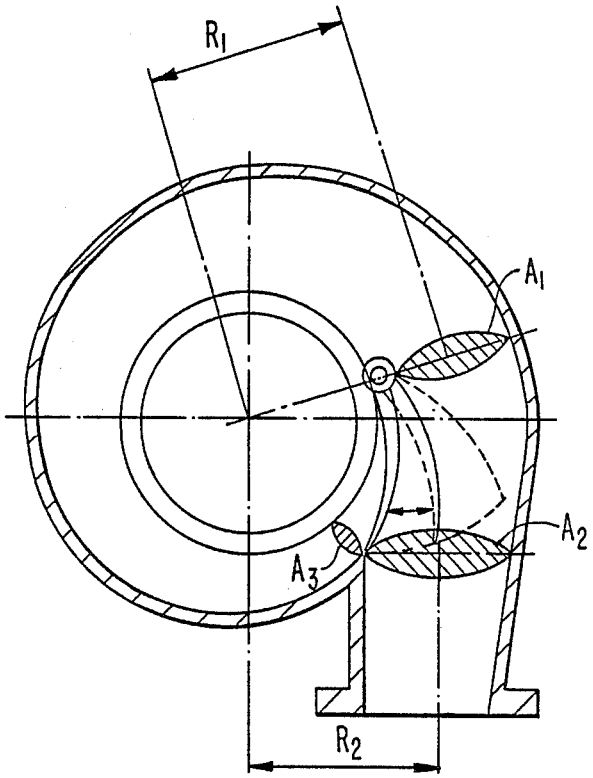
FIG. 5 is a longitudinal sectional view of the turbine housing, illustrating a scroll design method of design thereof.

A first embodiment of the present invention will be hereinunder described with reference to FIGS. 1 to 6. A turbine housing 31 has an exhaust passageway 35 which is divided into two parts by a partition 20 and incorporates a turbine wheel 32. An intake 36 of the passageway 35, through which exhaust gases flow into the turbine wheel, is provided with a vane 33. The vane 33 is supported by a bush 34 in such a manner as to be pivotable about a vane rotary shaft 37 mounted downstream of the exhaust passageway. The flow passage is scroll-shaped or scroll-like in configuration. FIG. 2 shows the turbine housing when the vane is closed and is in surface contact with a portion of the exhaust intake 36 so as to prevent the exhaust gas from flowing into the turbine wheel between the wall and the vane. In this case, the turbine flow rate is reduced, and the area at the entrance of the scroll corresponds to that at the proximal end of the vane 33, expressed as $A_1$, as shown in FIG. 5. Therefore, a value obtained by dividing the sectional area A of the flow passage at the scroll entrance by the perpendicular distance R from the central axis of the turbine wheel and the centroid of the sectional area A of the flow passage at the scroll entrance (hereinafter referred to as A/R) is a minimum. When the vane 33 is pivoted away from the position at which it is in contact with the exhaust intake 36, exhaust gas flows into the turbine wheel through an opening formed between the vane 33 and the turbine housing 31. At this point, the area at the scroll entrance is $A_2$, and the ratio A/R therefore increases, increasing the turbine flow rate.

Figure 6:
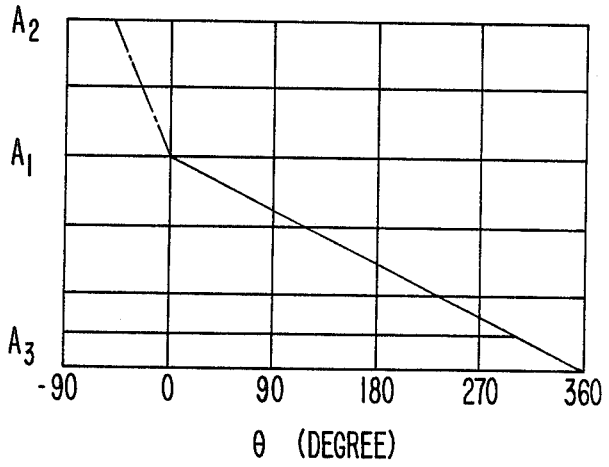
FIG. 6 is a graph used to illustrate the scroll design method.
Figure 7:
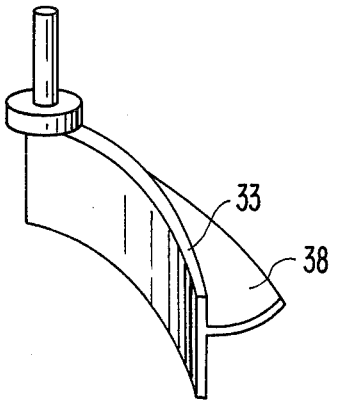
FIG. 7 is a perspective view of a vane employed in a second embodiment of the present invention.
Figure 8:
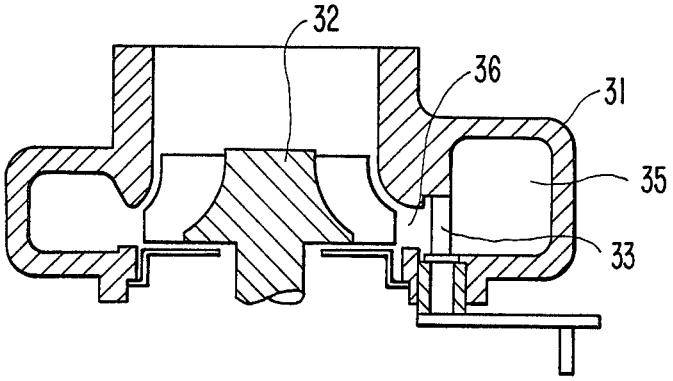
FIG. 8 PRIOR ART
FIG. 8 is a cross-sectional view of a conventional turbine.
Figure 9:
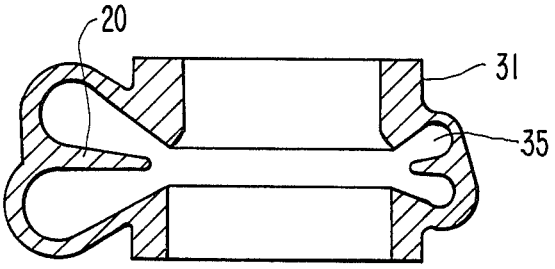
FIG. 9 PRIOR ART
FIG. 9 is a cross-sectional view of a conventional turbine housing which has a passageway divided into two parts.

Thus, minimum and maximum turbine flow rates can be changed by setting the area of the exhaust passageway 35. FIG. 6 shows an example of the method of designing the area thereof. The area of the scroll changes at a fixed rate in the circumferential direction, that is, as the angle $\theta$ increases as shown in FIG. 6, when $\theta$ is a counter clock-wise angle around the central axis of the turbine wheel and $\theta$ is 0° at the position of $A_1$. This change enables the designer to select a decrease in the area at a fixed rate or a decrease in the ratio A/R at a fixed rate with respect to the most aerodynamically appropriate angle. Therefore, the minimum turbine flow rate can be set by changing the scroll area $A_1$, and the maximum turbine flow rate can be set by changing the scroll area $A_2$. In addition, when the vane 33 is shifted to an open position, the scroll area changes from $A_2$ to $A_3$, providing the scroll with a large ratio A/R.

The vane 33 of this embodiment consists of a plate member and ribs 38 and 39 disposed at both sides of the plate member, by means of which the exhaust intake is divided into two parts when the vane 33 is open or closed.

A second embodiment of the present invention is described below, in which the rib 39 disposed on the side of the vane which is closer to the turbine wheel 32 is removed.

In this embodiment, when the turbine flow rate is small (when the vane 33 is closed), the exhaust gases flow into the turbine wheel in the same manner as in the first embodiment. However, when the turbine flow rate is set at its maximum by the pivoting of the vane 33, the exhaust passageway 35 which has been divided into two parts is made into one passage, because the vane 33 has no rib 39. In consequence, the exhaust gas introduced from the engine in one stream is mixed with that in another stream in exhaust passageway 35, reducing pulsations in the exhaust gases. This produces a state which is close to known hydrostatic supercharging, and enables a lower charging pressure than that of the first embodiment.

If the present invention is applied to a turbocharger, high charging pressure can be provided when the rotational speed of the engine is low by closing the vane 33 and thereby reducing the capacity of the turbine, which increases the torque of the engine at the low rotational speed. Further, if the capacity of the turbine is increased by opening the vane 33 when the engine is operating at a high rotational speed, the pressure of the exhaust gases can be reduced, thereby increasing the maximum output of the engine. These features in turn enable the engine performance to be improved over a wider range from a low rotational speed of the engine to a high rotational speed thereof, when compared with prior art turbochargers.

What is claimed is:

1. A variable capacity radial flow turbine comprising:

a housing having therein a turbine wheel, a scroll-shaped working gas passageway leading from an entrance to said turbine wheel in a direction of working gas flow, an intake from said passageway to said turbine wheel, and a partition dividing said passageway into two parallel parts; and means for adjusting the cross-sectional area of said two-part passageway and thus for smoothly changing the flow rate of working gas supplied to said turbine wheel, said means comprising a pivotally mounted vane for opening and closing said intake, said vane including a plate-like member having a downstream end in said direction of gas flow pivotally mounted adjacent the inner circumference of said passageway and an upstream end, and a rib extending from said plate-like member in a direction perpendicular thereto toward said partition.

2. A turbine as claimed in claim 1, wherein said vane further includes an additional rib extending from said plate-like member in a direction perpendicular thereto away from said partition.

* * * * *